US007294190B2

(12) United States Patent
Dyllick-Brenzinger et al.

(10) Patent No.: US 7,294,190 B2
(45) Date of Patent: Nov. 13, 2007

(54) MIXTURES OF SOLIDS, CONSISTING OF A REACTIVE SIZING AGENT AND STARCH, METHOD FOR PRODUCING SAID MIXTURES AND USE THEREOF

(75) Inventors: Rainer Dyllick-Brenzinger, Speyer (DE); Thomas Kessler, Schifferstadt (DE); Norbert Guentherberg, Speyer (DE); Peter Wittmer, Neustadt (DE); Roland Ettl, Hassloch (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 14 days.

(21) Appl. No.: 10/576,678

(22) PCT Filed: Oct. 15, 2004

(86) PCT No.: PCT/EP2004/011608

§ 371 (c)(1),
(2), (4) Date: Apr. 21, 2006

(87) PCT Pub. No.: WO2005/042842

PCT Pub. Date: May 12, 2005

(65) Prior Publication Data

US 2007/0074641 A1 Apr. 5, 2007

(30) Foreign Application Priority Data

Oct. 23, 2003 (DE) ..... 103 49 727

(51) Int. Cl.

| | |
|---|---|
| ***C08L 3/02*** | (2006.01) |
| ***C09D 103/02*** | (2006.01) |
| ***D21H 17/17*** | (2006.01) |
| ***D21H 21/16*** | (2006.01) |

(52) U.S. Cl. ..... 106/208.2; 162/175

(58) Field of Classification Search ..... 106/208.2; 162/175

See application file for complete search history.

(56) References Cited

U.S. PATENT DOCUMENTS

| | | | | |
|---|---|---|---|---|
| 3,102,064 | A | 8/1963 | Wurzburg et al. | |
| 3,223,544 | A | 12/1965 | Savina et al. | |
| 4,861,376 | A * | 8/1989 | Edwards et al. | 106/209.1 |
| 5,316,578 | A * | 5/1994 | Buehler et al. | 106/209.1 |
| 5,961,708 | A * | 10/1999 | Zetter et al. | 106/209.1 |
| 6,001,166 | A | 12/1999 | Ettl et al. | |
| 6,248,164 | B1 * | 6/2001 | H.ang.kansson | 106/287.2 |
| 6,565,640 | B1 * | 5/2003 | Bengs et al. | 106/209.1 |
| 2002/0096290 | A1 | 7/2002 | Lindgren et al. | |

FOREIGN PATENT DOCUMENTS

| | | |
|---|---|---|
| DE | 199 52 354 | 5/2001 |
| DE | 100 62 848 | 4/2002 |
| EP | 0 118 240 | 9/1984 |
| EP | 0 353 212 | 1/1990 |
| EP | 0 400 531 | 12/1990 |
| EP | 0 418 015 | 3/1991 |
| EP | 0 593 075 | 4/1994 |
| EP | 0 609 879 | 8/1994 |
| EP | 1 176 254 | 1/2002 |
| WO | WO 97/17491 * | 5/1997 |
| WO | 98/33979 | 8/1998 |
| WO | 00/03612 | 1/2000 |
| WO | 00/23651 | 4/2000 |
| WO | 01/88262 | 11/2001 |
| WO | 2004/022850 | 3/2004 |

* cited by examiner

*Primary Examiner*—David M Brunsman
(74) *Attorney, Agent, or Firm*—Oblon, Spivak, McClelland, Maier & Neustadt, P.C.

(57) ABSTRACT

Solid mixtures of a reactive size and starch, which are obtainable by mixing at least one reactive size with at least one starch in a melt in the presence of at least one destructuring agent for starch under the action of shear forces at from 65 to 250° C. and cooling the melt to room temperature, are used in the form of aqueous dispersions as process assistants in papermaking.

11 Claims, No Drawings

MIXTURES OF SOLIDS, CONSISTING OF A REACTIVE SIZING AGENT AND STARCH, METHOD FOR PRODUCING SAID MIXTURES AND USE THEREOF

This Application is a 371 filing of PCT/EP04/11608, filed 15 Oct. 2004.

The present invention relates to solid mixtures of a reactive size and starch, processes for their preparation and the use of aqueous dispersions of the mixtures as sizes for paper and paper products.

Aqueous alkylketene dispersions and processes for their preparation by emulsifying molten alkyldiketenes in water in the presence of cationic starch and an anionic dispersant as a stabilizer under the action of shear forces are known, cf. U.S. Pat. No. 3,223,544.

EP-A-0 353 212 discloses sizes for paper which are obtainable, for example, by emulsifying a fatty alkyldiketene in the presence of a cationic starch having an amylopectin content of at least 85%, preferably from 98 to 100%, and a degree of cationization (D.S.) of from 0.04 to 0.4 in water.

WO-A-00/23651 discloses aqueous, anionic size dispersions which are obtainable, for example, by dispersing alkyldiketenes in the presence of anionic dispersants as the sole stabilizer for the dispersed alkyldiketenes.

In the known processes for the preparation of aqueous sizes based on fatty alkyldiketenes, at least one fatty alkyldiketene is melted and is emulsified in water in the presence of an anionic emulsifier and of a cationic starch at above 80° C. At these temperatures, the starch is digested and is present as a colloidal solution. The alkyldiketenes dispersed in water have, for example, particle sizes of from 0.5 to 5 μm. The emulsifier immediately stabilizes the drops formed in the high pressure emulsification, and the starch surrounds the drops stabilized in this manner, as a protective colloid. This leads to long-term stabilization of the drops during the preparation of the emulsion and, after cooling of the emulsion, results in stabilization of the solid particles of the aqueous dispersion then present.

Commercial aqueous size dispersions based on alkyldiketenes have only a relatively low solids content (about 25% by weight). It is therefore necessary to transport large amounts of water to the end user. The dispersions prepared according to the prior art are also stable for only a few months, because slow hydrolysis and decarboxylation of the fatty alkyldiketenes take place immediately after the preparation, with the result that closed containers which comprise such sizes slowly expand. Owing to the large difference between the density of the continuous phase and that of the disperse phase, the dispersions are also subject to a slow creaming process, which results in the disperse system separating. Moreover, thickening processes are also known and likewise adversely affect the quality of the alkyldiketene dispersions during prolonged storage.

In addition, the use of aqueous dispersions of alkenylsuccinic anhydrides as reactive sizes for paper is known, cf. EP-A-0 609 879, EP-A-0 593 075 and U.S. Pat. No. 3,102,064.

EP-A-0 118 240 describes destructured starch. It is obtained by heating starch to a temperature above the melting point and glass transition temperature. EP-A-0 400 531 discloses mixtures which are based on destructured starch and can be used for the preparation of, for example, biodegradable films. They are obtainable by mixing natural starch with a high-boiling plasticizer, such as polyethylene glycol, polypropylene glycol or sorbitol, and a destructuring agent, such as urea, an alkali metal hydroxide or an alkaline earth metal hydroxide, in an extruder at from 120 to 170° C.

WO-A-00/03612 discloses a process for the preparation of drugs or precursors thereof.

Polysaccharides and/or derivatives thereof, preferably starch and/or starch derivatives, and at least one pharmaceutically active substance are plasticized in an extruder in the presence of water. With the use of a positively conveying extruder, for example, a water content of 15% by weight is sufficient.

DE-C-100 62 848 discloses a thermoplastic starch material which is dimensionally stable in water and is obtainable by extrusion of natural starch with a destructuring agent in an amount of from 30 to 60% by weight in a twin-screw extruder at from 65 to 120° C. and subsequent storage for retrogradation.

It is an object of the present invention to provide a size mixture which has a very low water content and which can be easily dispersed in water.

We have found that this object is achieved, according to the invention, by solid mixtures of a reactive size and starch which are obtainable by mixing at least one reactive size with at least one starch in a melt in the presence of at least one destructuring agent for starch Under the action of shear forces at from 65 to 250° C. and with cooling of the melt to room temperature. Solid mixture means that the components mixed with one another are present in the form of a finely divided mixture or agglomerate or as a solid-in-solid dispersion at room temperature (20° C.).

Suitable reactive sizes are, for example, selected from the group consisting of the $C_{14}$-to $C_{22}$-alkyldiketenes, the $C_{12}$-to $C_{30}$-alkylsuccinic anhydrides, the $C_{12}$-to $C_{30}$-alkenyl-succinnic anhydrides and mixtures of said compounds. At least one cationic starch is preferably used as the starch. The mixing of at least one reactive size with at least one starch is preferably effected in the presence of at least one emulsifier. The reactive sizes are preferably virtually anhydrous, whereas starch comprises up to 30, preferably from 2 to 25, in general from 5 to 20, % by weight of water. The starches can, if appropriate, have been dried and may have a water content of from 1 to 2% by weight.

Reactive sizes, such as alkyldiketenes and alkenyl—and alkylsuccinic anhydrides are known sizes for paper. They are described in more detail, for example, in the literature stated in connection with the prior art. Examples of fatty alkyldiketenes are tetradecyidiketene, oleyidiketene, palmityldiketene, stearyldiketene and behenyidiketene. Diketenes having different alkyl groups, e.g. stearylpalmityidiketene, behenylstearyldiketene, behenyloleyidiketene or palmitylbehenyldiketene, are also suitable. Stearyldiketene, palmityidiketene, behenyidiketene and mixtures of these diketenes are preferably used, as well as stearylpalmityidiketene, palmitylbehenyldiketene and behenylstearyldiketene.

The use of succinic anhydrides which are substituted by long-chain alkyl or alkenyl groups as engine sizes for paper is likewise known, cf. the publications EP-A-0 609 879, EP-A-0 593 075 and U.S. Pat. No. 3,102,064 mentioned in connection with the prior art. Alkenylsuccinic anhydrides comprise, in the alkenyl group, an alkylene radical of at least 6 carbon atoms in the alkylene group, preferably a $C_{14}$-to $C_{24}$-α-olefin radical. Examples of substituted succinic anhydrides are decenylsuccinic anhydride, octenylsuccinic anhydride, dodecylsuccinic anhydride and n-hexadecenylsuccinic anhydride. The substituted succinic anhydrides which are suitable as sizes for paper are preferably emulsified in water with cationic starch as a protective colloid.

For the preparation of the novel mixtures, it is possible to use all natural starch varieties and all derivatized starches, for example natural starches from potatoes, wheat, rye, com, peas, tapioca, cassava, rice and sago and derivatized starches which are obtainable, for example, by reacting natural starches with cationizing agents, such as glycidyltrimethylammonium chloride or 3-chloro-2-hydroxypropyltrimethylammonium chloride, or by reacting starch with cationic polymers, cf. WO-A-96/13525, page 3, line 26 to page 15, line 13. Preferably, polymers comprising vinylamine units, polyethyleneimines and/or polymers comprising basic acrylamide or basic acrylate groups, such as copolymers of acrylamide and dimethylaminoethyl acrylate or copolymers of acrylamide and dimethylaminoethylacrylamide, are used as cationic polymers for modifying natural and/or degraded starches (the degradation of the starch can be effected oxidatively, thermally, enzymatically or hydrolytically), said copolymers usually being used in the form quatemized with alkylating agents, such as methyl chloride.

Also of interest are starches whose amylpectin content is at least 95, preferably at least 98, % by weight, for example waxy corn starch, waxy wheat starch or waxy potato starch. They are preferably quatemized and have, for example, a degree of substitution (D.S.) of from 0.01 to 0.15. The degree of substitution indicates the number of cationic groups per monosaccharide unit in the cationic starch.

Further suitable modified starches are oxidized natural starches or oxidized derivatized starches, oxidatively, thermally, hydrolytically and/or enzymatically degraded starches, anionically modified starches and amphoteric starches. A synopsis on starches is to be found, for example, in the book by Günther Tegge, Stärke und Stärkederivate, Hamburg, Bers-Verlagl1984. In the preferred embodiment of the invention, at least one cationic starch is used. The degree of substitution of the cationic starches is, for example, from 0.01 to 1.0, preferably from 0.02 to 0.3.

In the preparation of the novel solid mixtures from a reactive size and starch, it is possible, if appropriate, concomitantly to use at least one anionic dispersant and/or surfactant having an HLB value of, for example, from 8 to 20 [for the definition of the HLB value, cf. W. C. Griffin, Journal of the Society of Cosmetic Chemists, 1 (1950), 311]. This ensures that the solid mixtures are better dispersible on introduction into water, and the dispersions prepared therefrom are more stable than those mixtures which are free of dispersants and surfactants. Suitable anionic dispersants are, for example, condensates of naphthalenesulfonic acid and formaldehyde, phenol, phenolsulfonic acid and formaldehyde, naphthalenesulfonic acid, formaldehyde and urea and phenol, phenolsulfonic acid, formaldehyde and urea. The anionic dispersants may be present in the form of the free acids, of the alkali metal salts, of the alkaline earth metal salts and/or of the ammonium salts. The ammonium salts may be derived both from ammonia and from primary, secondary and tertiary amines; for example, the ammonium salts of dimethylamine, trimethylamine, hexylamine, cyclohexylamine, dicyclohexylamine, ethanolamine, diethanolamine and triethanolamine are suitable. The condensates described above are known and are commercially available. They are prepared by condensing said components, it also being possible to use the corresponding alkali metal, alkaline earth metal or ammonium salts instead of the free acids. Suitable catalysts for the condensation are, for example, acids such as sulfuric acid, p-toluenesulfonic acid and phosphoric acid. Naphthalenesulfonic acid or the alkali metal salts thereof are condensed with formaldehyde preferably in a molar ratio of from 1:0.1 to 1:2, in general from 1:0.5 to 1:1. The molar ratio for the preparation of condensates of phenol, phenolsulfonic acid and formaldehyde is likewise in the abovementioned range, any desired mixtures of phenol and phenolsulfonic acid being used instead of naphthalenesulfonic acid in the condensation with formaldehyde. Instead of phenolsulfonic acid, it is also possible to use the alkali metal and ammonium salts of phenolsulfonic acid. The condensation of the abovementioned starting materials can, if appropriate, additionally be carried out in the presence of urea. For example, from 0.1 to 5 mol of urea per mole of naphthalenesulfonic acid or per mole of the mixture of phenol and phenolsulfonic acid are used.

The condensates have, for example, molar masses of from 800 to 100 000, preferably from 1 000 to 30 000, in particular from 4 000 to 25 000. Salts which are obtained, for example, by neutralizing the condensates with alkali metal hydroxides, such as sodium hydroxide or potassium hydroxide, or ammonia are preferably used as anionic dispersants.

Furthermore, ligninsulfonic acid and salts thereof, such as sodium ligninsulfonate or calcium ligninsulfonate, can be used as anionic dispersants.

Amphiphilic copolymers of hydrophobic monoethylenically unsaturated monomers and hydrophilic monomers having an anionic group, such as monoethylenically unsaturated carboxylic acids, monoethylenically unsaturated sulfonic acids, monoethylenically unsaturated phosphonic acids or mixtures thereof, can also be used as anionic dispersants. Such copolymers have, for example, a molar mass $M_w$of from 1 500 to 100 000. Examples of such dispersants are copolymers of $C_4$- to $C_{12}$-olefins and maleic anhydride. The molar ratio of maleic anhydride to olefin is, for example, from 0.9:1 to 3:1. These copolymers are preferably used in hydrolyzed form as salts with alkali metal or ammonium ions. If an anionic dispersant is used in the preparation of the novel mixtures, the amounts used are from 0.1 to 20, preferably from 0.5 to 10, % by weight.

If appropriate, surfactants, such as alkoxylated alcohols of 12 to 24 carbon atoms having a degree of ethoxylation and/or degree of propoxylation of from 4 to 50, preferably from 5 to 20, can be concomitantiy used in the preparation of the novel mixtures. The amount of surfactants concomitantly used, if appropriate, is from 0.1 to 5, preferably from 0.3 to 3, % by weight, based on reactive size.

The two substantial components of the mixture—reactive size and starch—are preferably homogenized in an extruder or kneader. Preferred mixing units are self-purging extruders whose shaft or shafts are equipped with mixing and/or kneading elements. Suitable extruders are, for example, twin-screw extruders or planetary extruders. The water content of the starch is generally sufficient to ensure destructuring (digestion) of the starch during the mixing of the starch with at least one reactive size. In a preferred embodiment of the invention, starch is digested by passing steam into the melt. Particularly homogeneous mixtures are obtained if reactive size and starch are mixed continuously in an extruder under the action of ultrasound.

The extruder used can be divided into a plurality of process zones. The individual process zones need not be identical to the individual extruder sections. In general, a process zone extends over a plurality of extruder sections.

The following general scheme is an example of the novel process:

Zone 1: Feed of the components, may extend over a plurality of sections and is provided with feed orifices for solid, liquid feed and, if appropriate, vapor feed. One or more feed orifices can be provided per extruder section.

The feed orifices may be located at the top, at the side or at the bottom of each of the extruder sections considered, any conceivable combination being possible, for example large feed orifices at the top for powder metering and at the bottom or side for liquid metering and, if appropriate, feed orifices at the top, side or bottom for vapor.

In another particular embodiment, the solid components are fed to the extruder via a metering and feed means at the side, and the liquid components and, if appropriate, the vapor are introduced from the side, from above or from below.

In a preferred embodiment, the solid, generally pulverulent components (starch) are introduced via a side feed means into the same section as the liquid components (reactive sizes). Vapor can if appropriate be fed to a section downstream via a valve. In the region of zone 1, the screw elements are, for example, in the form of pure conveying elements, and may differ in pitch, number of flights and profile according to the task. In a preferred embodiment, double-flight screw elements of different pitch having an earth mixer profile are used. However, other profiles, for example a thrust edge profile, etc., are also conceivable.

In the subsequent zone 2, which as a rule likewise extends over a plurality of extruder sections, the starch digestion takes place through thorough mixing and kneading of the components. As a rule, closed barrels are used here. In this region, the extruder screw is equipped with conveying and mixing elements which can be chosen to be different and arranged differently depending on starting materials used and the ratio thereof. Suitable conveying elements are all elements described above under zone 1. Suitable mixing and kneading elements are neutral or conveying kneading blocks of different width and with different numbers of kneading disks, backward-conveying kneading blocks also being suitable. Other suitable mixing elements are toothed disks, toothed mixing elements and melt mixing elements of a very wide range of embodiments, as are available from various manufacturers. Hold-up disks and backward-conveying screw elements can also have the desired mixing effect. In a particular novel embodiment, the extruder is equipped in a part of zone 2 alternately with conveying and individual mixing and kneading elements. In another preferred embodiment, it is equipped alternately with conveying elements and groups of kneading elements.

In a very particularly preferred embodiment, the digestion of the starch is supported by the additional introduction of energy, for example with the aid of ultrasound.

Zone 2 is followed by the mixing-in zone 3, in which the digested starch is combined with a melt of at least one reactive size. The reactive size is melted separately from the extruder, for example in a vessel. The melt of the reactive size is metered at the beginning of the mixing-in zone, for example by means of an injection valve, from above, from below or from the side of the extruder, through an orifice in the corresponding extruder section. A plurality of injection orifices which may be arranged parallel to one another, one on top of the other, opposite one another or in a circle around the extruder cross section is also conceivable. Apart from the metering section having at least one metering orifice, the mixing-in section comprises further closed barrel sections.

In said mixing-in section, the extruder screw comprises conveying and mixing elements. Elements as described, for example, in the descriptions of zones 1 and 2 are suitable. The arrangement is preferably such that mixing and conveying elements alternate with one another. Groups of conveying kneading blocks or toothed mixing elements may be mentioned by way of example, combinations of conveying and back-conveying or conveying and neutral kneading blocks also being suitable.

The mixing-in zone 3 is followed by the devolatilization zone 4. In this region, the extruder has one or more barrel sections with one or more devolatilization orifices. The devolatilization orifices preferably have a large cross section in order to ensure very high devolatilization performance. They may be arranged at the top or laterally on one or two sides, or both at the top and laterally as well as at the bottom, if suitable measures are taken to suppress the emergence of the extruder content. The devolatilization orifices can be operated only at atmospheric pressure or partly at atmospheric pressure and partly under reduced pressure. In certain cases, operation under superatmospheric pressure is also conceivable. In the devolatilization zone, readily volatile components are removed from the mixture; in particular, the water required for the starch digestion is completely or partly removed from the mixture in this part of the extruder.

The devolatilizations can be operated as a simple devolatilization dome with corresponding inserts in the extruder orifices. However, the use of hold-up screws at the devolatilization orifices is also possible for preventing the emergence of product. In a particularly preferred embodiment, the devolatilizations are operated at atmospheric pressure and without hold-up screws. In another preferred embodiment, the devolatilizations are operated under reduced pressure. In a further preferred embodiment, the devolatilizations are carried out at different pressures, for example the first at atmospheric pressure and the others under reduced pressure. The extruder screw essentially has conveying elements in the devolatilization region. In a particular embodiment, when operating different devolatilization orifices at different pressure, it may also be advantageous to use hold-up elements (as described, for example, as kneading elements under zones 1 and 2).

The devolatilization zone 4 is followed by the discharge zone 5. This consists of one or more closed barrels having conveying screw elements. The discharge zone may be closed by a die plate, a slot die or other elements. The extruder can, however, also be connected directly to a shaping process part in which the emerging melt is brought to a further processible form (powder, granules, extrudate, scales). For the production of pellets or scales, the machines known from the prior art, for example a cooling belt, chill roll or the like, are used. For powders, milling units are generally connected.

In a particular embodiment, the extruder is cooled in the discharge region so that the finished product is discharged as an agglomerated powder. In another preferred embodiment, the cooling melt is dripped onto a cooling belt or a chill roll via a die bar, said melt solidifying. In this case, the product would be dust-free granules or pastilles.

The mixing of reactive size and starch is carried out in the presence of a destructuring agent for starch. Such agents are necessary for digesting starch. Examples of destructuring agents are water, alcohols, urea, dimethylurea and/or polyalkylene glycols, such as polyethylene glycol, polypropylene glycol, block copolymers of ethylene oxide and propylene oxide and polyalkylene glycols endcapped at one or both ends with $C_1$- to $C_{22}$-alkyl groups. A preferably used destructuring agent is water, which, for example, is virtually always present in the preparation of the mixtures owing to the moisture content of starch or is added during the mixing. As described above, water can be introduced into the mixing apparatus in the form of vapor, in particular as superheated steam.

Reactive size and starch are used, for example, in a weight ratio of from 10:1 to 1:10. The mixing ratio of reactive size to starch is in general between 9 parts by weight of reactive size and 1 part by weight of starch and 1 part by weight of reactive size and 9 parts by weight of starch. Particularly preferred mixtures comprise from 2 to 6, in particular from 3 to 5, parts by weight of reactive size per part by weight of starch.

The present invention also relates to a process for the preparation of solid mixtures of a reactive size and starch, at least one reactive size being mixed with at least one starch in a melt in the presence of at least one destructuring agent for starch under the action of shear forces at from 65 to 250° C., preferably from 75 to 190° C., and the melt then being cooled to room temperature. The mixing of the individual components can be carried out batchwise or continuously. For example, at least one compound from the group consisting of the $C_{14}$- to $C_{22}$-alkyldiketenes, $C_{12}$-to $C_{30}$-alkylsuccinic anhydrides, $C_{12}$- to $C_{30}$-alkenylsuccinic anhydrides or mixtures thereof is used as reactive size and preferably a cationic starch is used as starch. The two components are preferably mixed in the presence of at least one emulsifier in an extruder while passing superheated steam into the mixing, zone of the extruder. In order to prepare particularly homogeneous mixtures, mixing of the components is carried out continuously in an extruder under the action of ultrasound.

The mixtures thus obtained, which are present at room temperature in solid form, for example as powders, extrudates, scales or granules, are readily dispersible in water, in particular if they comprise an emulsifier. The particle size of the reactive size in the mixture with starch is, for example, from 0.1 to 100 μm, preferably from 0.5 to 5 μm. The reactive sizes are present in the solid mixture in a form distributed through the mixture or as aggregates. The novel mixtures are used in the form of aqueous dispersions as process assistants in papermaking. Such aqueous dispersions, which are added to the paper stock in papermaking, lead to engine sizing and to strengthening of paper. However, they can also be used for the surface sizing of paper.

In the examples which follow, parts and percentages are by weight, unless evident otherwise from the context.

The determination of the degree of sizing was based on $Cobb_{60}$ according to DIN EN 20 535. The ink flotation time was determined according to DIN 53 126 using a test ink (blue). The mean particle size of the dispersed particles of the dispersion was determined by Fraunhofer diffraction using a Coulter apparatus of the type LS 230 with a small volume module.

EXAMPLE 1

A pilot-scale extruder of the ZSK 25 series from Coperion Werner & Pfleiderer, having a screw diameter of 25 mm and a total length of 13 sections, was used.

The starch in the form of a powder was fed in from the side via a conveying screw of the type ZSB 25 in section 2. A mixture of water and emulsifier was pumped into the same section.

Steam having the temperature stated in table 1 was metered into section 3 via a steam generator.

Sections 4-6 contained the starch digestion zone having groups of kneading blocks. In this region, an ultrasonic finger (Dr. Hilscher, Watt ) was installed for supporting the digestion of the starch and for better homogenization.

Sections 7-9 contained the mixing-in zone for alkyldiketene (AKD). AKD was melted in a separate container and metered in by means of a pump with a defined throughput.

Sections 10-11 contained the devolatilization zones having devolatilization orifices present at the top and operated under atmospheric pressure.

Sections 12-13 contained the discharge zones, which were operated at lower temperatures than the remainder of the extruder.

All relevant data are shown in table 1.

Component 1: Cationic starch Hi-Cat® (Roquette) 21370, 89% strength

Component 2: Commercial anionic emulsifier (naphthalenesulfonic acid condensate (Tamol® NN)) dissolved in water, 6.23% strength Component 3: Steam, 180° C. feed temperature Component 4: $C_{16}$-/$C_{18}$-Alkyldiketene (separately melted and metered at a temperature of 75-80° C.)

TABLE 1

| Component | Unit | Example 1 | Example 2 | Example 3 |
|---|---|---|---|---|
| 1 | g/h | 810 | 972 | 1620 |
| 2 | g/h | 600 | 720 | 900 |
| 3 | g/h | 450 | 540 | 900 |
| 4 | g/h | 3000 | 3600 | 6000 |
| Screw speed | $min^{-1}$ | 150 | 150 | 150 |
| Residence time | sec | 134 | 124 | 80 |
| Temperature profiles | ° C. | | | |
| Sections 1-5 | | 100 | 100 | 100 |
| Sections 6-10 | | 110 | 110 | 110 |
| Section 11 | | 29 | 27 | 74 |
| Section 12 | | 29 | 27 | 22 |
| Ultrasonic amplitude | % | 100 | 100 | 100 |
| NFA | % | 82.4 | 81.4 | 82.4 |
| Product consistency at extruder exit | | white, friable | white, friable | white, friable |

EXAMPLES 4 to 6

Emulsification of the mixtures of AKD and starch in water 468 g of the mixtures of alkyldiketene and starch, prepared according to examples 1 to 3, were emulsified in 1 032 kg of demineralized water at 85° C. using an Ultraturrax in the course of 10 minutes and then homogenized twice at 150 bar in an APV-Gaulin high-pressure homogenizer of the type LAB 100. Thereafter, the emulsion was immediately cooled to 20° C. and the properties of the dispersions stated in table 2 were determined.

Testing of performance characteristics as engine size:

A 0.8% strength slurry of a mixture of birch sulfate and pine sulfate in water was prepared. 20%, based on fiber, of ground calcium carbonate were metered into this fiber suspension. 0.5% of a cationic starch, the sizes used according to table 2 in a concentration of 0.08 g/l in each case and a retention aid (anionic polyacrylamide) were then added. Laboratory sheets having a basis weight of 80 $g/m^2$ were then produced therefrom in a Rapid-Kö then sheet former, said sheets were dried and were conditioned for 24 hours at 23° C. and 50% relative humidity, and the sizing effect of the sizes used in each case was then determined. The results are shown in table 2.

TABLE 2

| | Stability of the dispersion after 90 d/RT | Viscosity of the dispersion after 90 d/RT | Particle size distribution in μm | $Cobb_{60}$ with 0.08 g/l | Ink flotation time in min |
|---|---|---|---|---|---|
| Basoplast 2030 LC* (Comparative example) | moderate | 600 mPas | 1.2 | 35 | 35 |
| Example 4 (Dispersion of the mixture of example 1) | very good | 520 mPas | 0.8 | 31 | 35 |
| Example 5 (Dispersion of the mixture of example 2) | Good | 420 mPas | 0.72 | 30 | 35 |
| Example 6 (Dispersion of the mixture of example 3) | very good | 550 mPas | 0.75 | 31 | 35 |

*Basoplast 2030 LC is a commercial 20.5% strength aqueous AKD dispersion

We claim:

1. A solid mixture of at least one compound from the group consisting of the $C_{14}$- to $C_{22}$-alkyldiketenes as reactive size and starch, wherein said mixture is obtainable by mixing at least one compound from the group consisting of the $C_{14}$- to $C_{22}$-alkyldiketenes with at least one starch in a melt in the presence of at least one destructuring agent for starch under the action of shear forces at from 65 to 250° C. and with cooling of the melt to room temperature.

2. The solid mixture of a reactive size and starch according to claim 1, wherein the starch used is a cationic starch, and the mixing is carried out in the presence of at least one emulsifier.

3. The solid mixture of a reactive size and starch according to claim 1, wherein the mixing of the components is effected in an extruder or kneader.

4. The solid mixture of a reactive size and starch according to claim 1, wherein the mixing of the components is effected continuously in an extruder under the action of ultrasound.

5. A solid mixture of a reactive size and starch according to claim 1, wherein the destructuring agent used is water, an alcohol, urea, dimethylurea and/or a polyalkylene glycol.

6. The solid mixture of a reactive size and starch according to claim 1, wherein reactive size and starch are used in a weight ratio of from 10:1 to 1:10.

7. The solid mixture of a reactive size and starch according to claim 1, wherein the starch is digested during the mixing process by passing steam into the melt.

8. A method of using a solid mixture of a reactive size and starch according to claim 1 in the form of an aqueous dispersion as a process assistant in papermaking.

9. The method of claim 8, wherein the aqueous dispersion is used for the engine sizing and surface sizing and for the strengthening of paper.

10. A process for the preparation of solid mixtures of at least one compound from the group consisting of the $C_{14}$- to $C_{22}$-alkyldiketenes as reactive size and starch, wherein at least one compound from the group consisting of the $C_{14}$- to $C_{22}$-alkyldiketenes is mixed with at least one starch in a melt in the presence of at least one destructuring agent for starch under the action of shear forces at from 65 to 250° C., and the melt is then cooled to room temperature.

11. The process as claimed in claim 10, wherein the starch used is a cationic starch, and the two components are mixed in the presence of at least one emulsifier in an extruder while passing superheated steam into the mixing zone of the extruder.

* * * * *